US005460534A

United States Patent [19]

Taniuchi et al.

[11] Patent Number: 5,460,534

[45] Date of Patent: Oct. 24, 1995

[54] CONNECTOR USING LEVER ACTION

[75] Inventors: Osamu Taniuchi; Hitoshi Okumura; Hajime Kawase; Youichi Nankoh; Hiroyuki Nakata; Kazuhisa Kondo; Makoto Fukamachi; Satoru Nishide, all of Mie, Japan

[73] Assignee: Sumitomo Wiring Systems, Ltd., Mie, Japan

[21] Appl. No.: 177,400

[22] Filed: Jan. 5, 1994

[30] Foreign Application Priority Data

| | | | |
|---|---|---|---|
| Jan. 6, 1993 | [JP] | Japan | 5-002646 U |
| Jan. 7, 1993 | [JP] | Japan | 5-002865 U |
| Jan. 13, 1993 | [JP] | Japan | 5-003778 U |

[51] Int. Cl.[6] ..... H01R 13/62

[52] U.S. Cl. ..... 439/157; 439/372

[58] Field of Search ..... 439/152, 153, 439/157, 159, 372

[56] References Cited

U.S. PATENT DOCUMENTS

| | | | |
|---|---|---|---|
| 3,059,206 | 10/1962 | Williams | 339/45 |
| 5,135,410 | 8/1992 | Kawase et al. | 439/372 |
| 5,205,752 | 4/1993 | Taguchi et al. | 439/157 |
| 5,279,506 | 1/1994 | Kawase et al. | 439/157 |
| 5,330,411 | 7/1994 | Fujitani et al. | 439/157 |

FOREIGN PATENT DOCUMENTS

| | | | |
|---|---|---|---|
| 1006047 | 1/1952 | France . | |
| 2179506 | 3/1987 | United Kingdom | 439/372 |

*Primary Examiner*—Daniel W. Howell

*Attorney, Agent, or Firm*—Sughrue, Mion, Zinn, Macpeak & Seas

[57] ABSTRACT

A pair of connector housing may be temporarily engaged so as to facilitate efficient connection operation thereof. A lever 15 is pivotably attached to a side wall of the male connector housing 11. When a female connector housing 12 is inserted into the male connector housing 11, a cam receiving protrusion 17 of a cover 13 resiliently deforms lugs 15*a* of a lever 15 to be opened, so that the cam receiving portion may be advanced through a portion 23 into a cam groove 16. After such advancement, lugs 15*a* are returned to their original position by means of resilient deformation, so that the portion 23 is engaged with the cam receiving protrusion 17, so as to prevent dislodgement of the cam receiving protrusion. The thickness of the portion 23 of the cam groove is selected so as to prevent dislodgement of the cam receiving protrusion. A restricting protrusion 24 is protruded laterally from the cam receiving protrusion 17. The restricting protrusion serves to urge the lugs 15 downwardly, so as to maintain constant amount of engagement between the cam receiving protrusion 17 and the portion 23 of the cam groove. Another restricting protrusion 25 extending in a vertical direction may be provided in the side wall 1 of the male connector housing 11.

3 Claims, 15 Drawing Sheets

CONNECTOR USING LEVER ACTION

BACKGROUND OF THE INVENTION

1. Field of the Invention

The invention relates to an improved connector of a lever type which may be connected together using "lever action".

2. Statement of the Prior Art

The above connector has an advantage in that it may be connected or disconnected with a small amount of force. Such connectors are particularly used in a multiple-pole connector having 20 (twenty) or more poles. The basic principle for such connectors is based on "lever action". Such connectors are well known and disclosed for example in Japanese Patent Public Disclosure No. 4-627724.

For convenience of illustration, a prior art lever connector will be first explained below with reference to FIGS. 13A–13D. FIGS. 13A–13D are schematic side elevational views showing operation of the prior art lever connector.

In FIGS. 12A–12D, a female connector housing 1 into which a female terminal is housed is shown in the upper portion, and a male connector housing 2 into which a male terminal is housed is shown in the lower portion. The female connector housing 1 is insertable within the male connector housing 2. A lever 3 is mounted on the male connector housing 2. The lever 3 is pivotable about a support axis 2*a* and has a cam groove 3*a* for effecting "lever action". The female connector housing 1 includes a cover 4 having a cam receiving protrusion 4*a*.

In order to connect the housing 1, 2 together, the cam receiving protrusion 4*a* of the cover 4 attached to the female housing 2 is fitted into the cam groove 3*a* of the lever 3, as shown in FIG. 13B. Then, the lever 3 is rotated as shown by an arrow mark in the drawing so that the position or posture of the lever 3 is changed so that shown in FIG. 13D, via FIG. 13C. By this, the cam receiving protrusion 4*a*, and thus the cover 4, is displaced downwardly as viewed in the drawing by means of a lever action of the cam groove 3*a*. Consequently, the female connector housing 1 is inserted in the male connector housing 2 in its entirety, so that a plurality of terminals of both connector housings are coupled.

In order to conduct connection procedure of such a connector, the cam receiving protrusion 4*a* is first inserted in the cam groove 3*a*, and then the lever 3 is rotated so as to displace the cam receiving protrusion downwardly. Accordingly, it is necessary for the cam receiving protrusion 4*a* to be securely advanced into the cam groove 3*a*, in order to rotate the lever 3.

It is noted, however, that the cam receiving protrusion 4*a* is not always securely advanced into the cam groove 3*a*, when the female connector housing 1 is simply inserted into the male connector housing 2. It is also possible for the cam receiving protrusion 4*a*, even when it is once advanced properly, to be disengaged from the cam groove 3*a* prior to necessary pivot operation of the lever 3.

Under the circumstances, it is necessary for an operator to conduct a complicated operation as follows. In order to connect or combine the pair of connector housings, the female housing 1 is inserted into the male housing 2, and then, the cam receiving protrusion 4*a* is securely advanced into the cam groove 3*a* by applying a finger or fingers on the lever 3, while holding the female housing 1 with the opposite hand. After confirming that the cam receiving protrusion 4*a* has been properly inserted into the cam groove 3*a*, the lever 3 should be raised with the female housing 1 being lightly held.

In order to avoid such a complicated or wearisome procedure, it is preferred that the female housing 1 having been inserted into the male housing 2 be temporarily held in a position.

A principal concept conceivable to achieve the above construction is to provide mating engagement pawls on the pair of connector housings 1, 2. With such a construction, it is necessary to mold engagement pawls in an undercut configuration. This requires a complicated mold die for forming connector housings, thus increasing costs for such die. It also requires a number of holes to be punched in the connector housings, thus reducing strength of the connector housings.

SUMMARY OF THE INVENTION

It is an object of the invention to provide a lever type connector including a pair of connector housings which may be temporarily engaged with each other so as to make connection work efficient, while obviating deficiency such as a reduction in strength of the connector housings.

In accordance with the invention, a lever connector comprising a pair of mating connector housings is provided. One of the connector housings includes a lever pivotably mounted thereon. The other of the connector housings includes a cam receiving protrusion for engaging with a cam groove formed in the lever so that the pair of connector housings may be connected together or disconnected from one another by pivoting the lever so as to displace the cam receiving protrusion. The cam groove is formed into a closed configuration at the portion thereof into which the cam receiving protrusion is advanced. The thickness of said portion of said cam groove is selected so that it permits advancement of the cam receiving protrusion thereinto by means of resilient deformation of the lever, while preventing dislodgement of the cam receiving protrusion, once advanced, by means of engagement between the cam groove and the cam receiving protrusion.

In accordance with the lever type connector, and when one of the connector housings is inserted into the other of the connector housings provided with the lever in order to connect the pair of connector housings, the cam receiving protrusion causes the lever to be resiliently deformed. By this, the cam receiving protrusion is advanced into the cam groove of a closed configuration. The thickness of the portion of the cam groove into which the cam receiving protrusion is advanced is selected so as to permit advancement of the cam receiving protrusion when the lever is resiliently deformed, and so as to resiliently return the wall of the cam groove, once advanced, to its original position in order engage with the cam receiving protrusion. Thus, it is possible for the connector housings to be temporarily engaged with each other, once the cam receiving protrusion has been advanced into the cam groove. This permits the operator to disengage his hand from the connector.

It is not necessary to provide the connector housings with engagement structure since the connector housings may be temporarily engaged with each other by means of the lever.

It is possible to provide a restricting protrusion between the vicinity to the cam receiving protrusion and the lever in order to maintain a constant amount of engagement between the cam receiving protrusion and the portion of the cam groove into which the cam receiving protrusion is advanced. Due to the face that the restricting protrusion is provided between the vicinity to the cam receiving protrusion and the lever, it is possible to obtain a constant amount of engagement between the cam receiving protrusion and the above portion of the cam groove so as to make the temporary engagement stable, even when the lever and connector housings have a variance in molding accuracy.

It is also possible to provide a separate restricting protrusion in the side wall of the connector housing having the lever in order to maintain a constant amount of engagement between the cam receiving protrusion in contact with the lever and the above portion of the cam groove. Due to the fact that the restricting protrusion in contact with the lever is provided, it is possible to obtain a constant amount of engagement between the cam receiving protrusion and the above portion of the cam groove so as to make the temporary engagement stable, even when the lever and connector housings have a variance in molding accuracy.

In accordance with the lever type connector according to the invention, one of the connector housings may be temporarily engaged with the lever, so that efficient connection work for the connector may be carried out. It is unnecessary to provide an engagement structure on the connector housings, so that reduction in strength of the connector and increase in the costs of mold die may be avoided. It is also possible to obtain a constant amount of engagement between the cam receiving protrusion and the above portion of the cam groove so as to make the temporary engagement stable, even when the lever and connector housings have a variance in molding accuracy.

BRIEF DESCRIPTION OF THE INVENTION

Figure 10A:
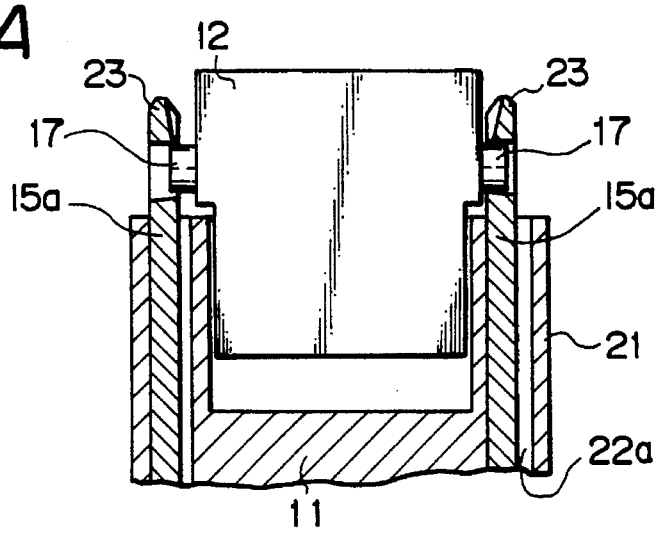
Figure 10B:
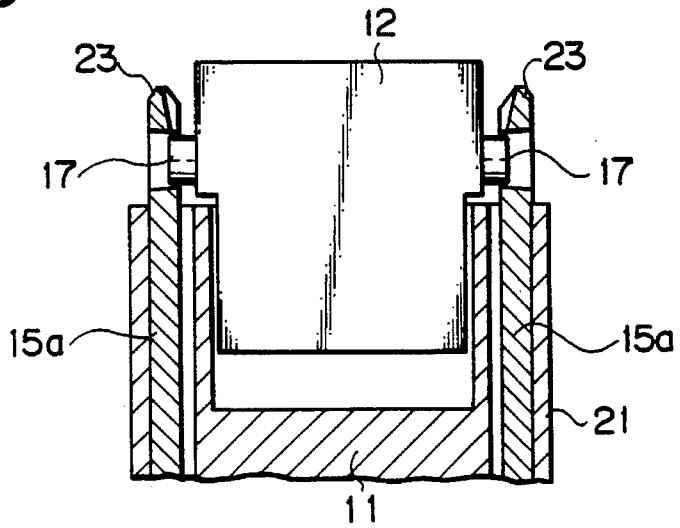
Figure 10C:
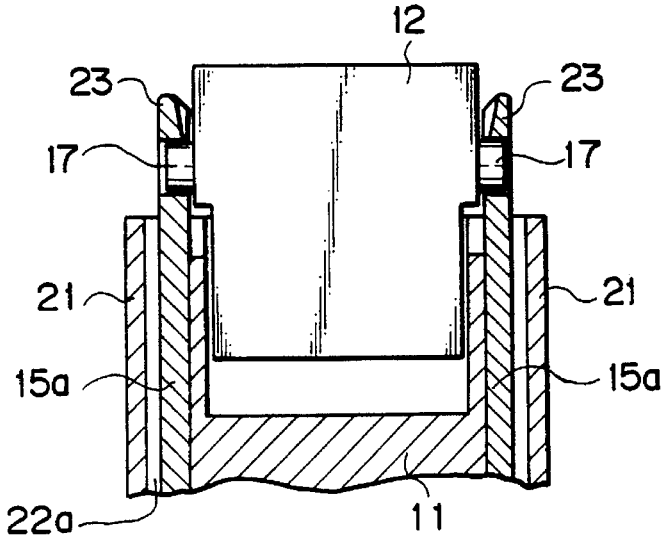
Figure 11:
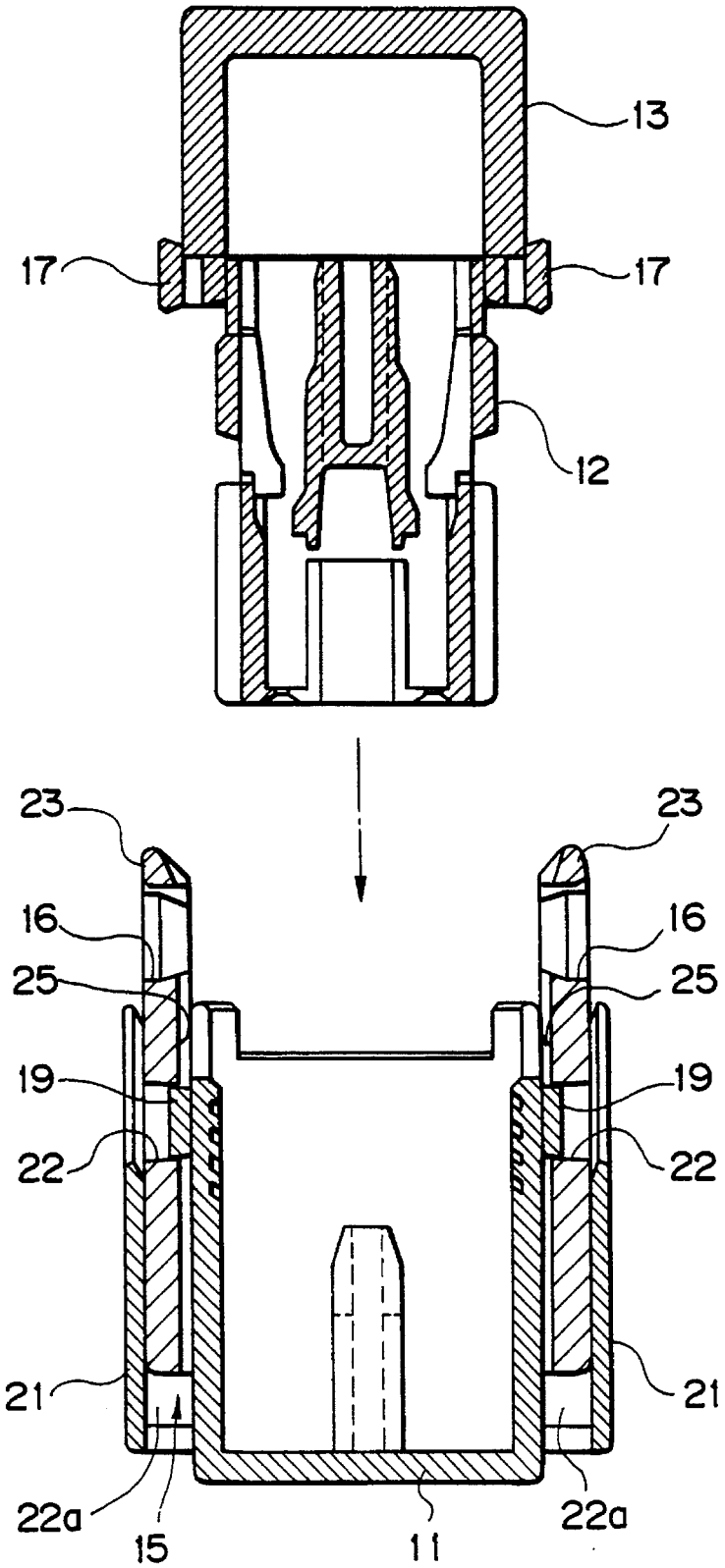
Figure 12:
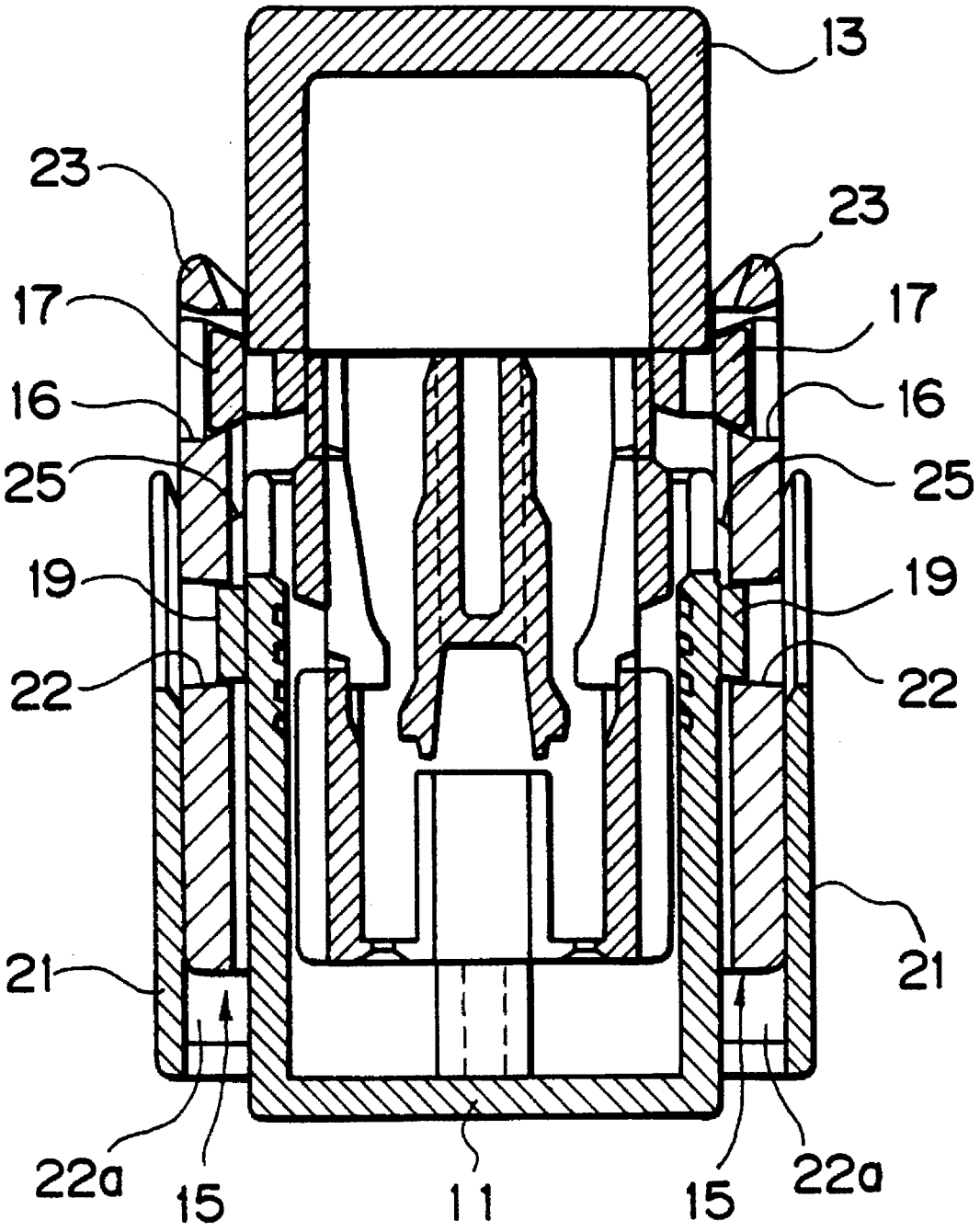
Figure 13A:
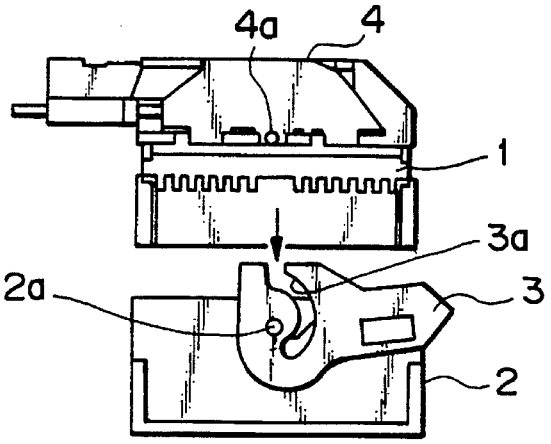
Fig.13A PRIOR ART
Figure 13B:
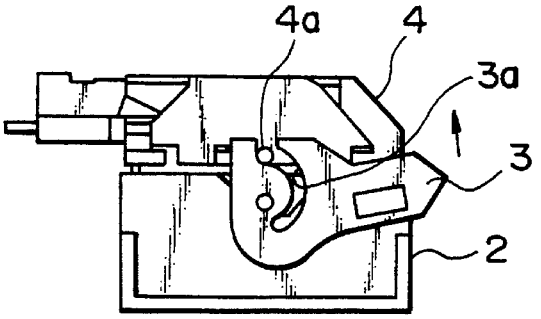
Fig.13B PRIOR ART
Figure 13C:
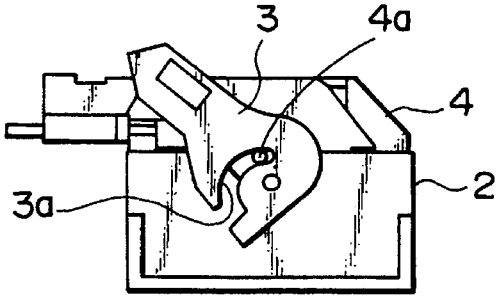
Fig.13C PRIOR ART
Figure 13D:
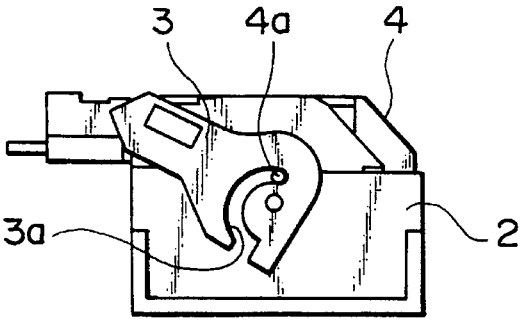
Fig.13D PRIOR ART

FIGS. 10A–10C a virtual sectional view illustrating the operation of the restricting protrusion in the third embodiment of the invention;

FIG. 11 is a longitudinal sectional view illustrating the lever connector, before connection, according to the third embodiment of the invention;

FIG. 12 is a longitudinal sectional view illustrating the lever connector, after connection, according to the third embodiment of the invention; and FIGS. 13A–13D are a schematic side elevational view illustrating a lever connector in prior art.

DETAILED DESCRIPTION OF THE PREFERRED EMBODIMENTS

Figure 1A:
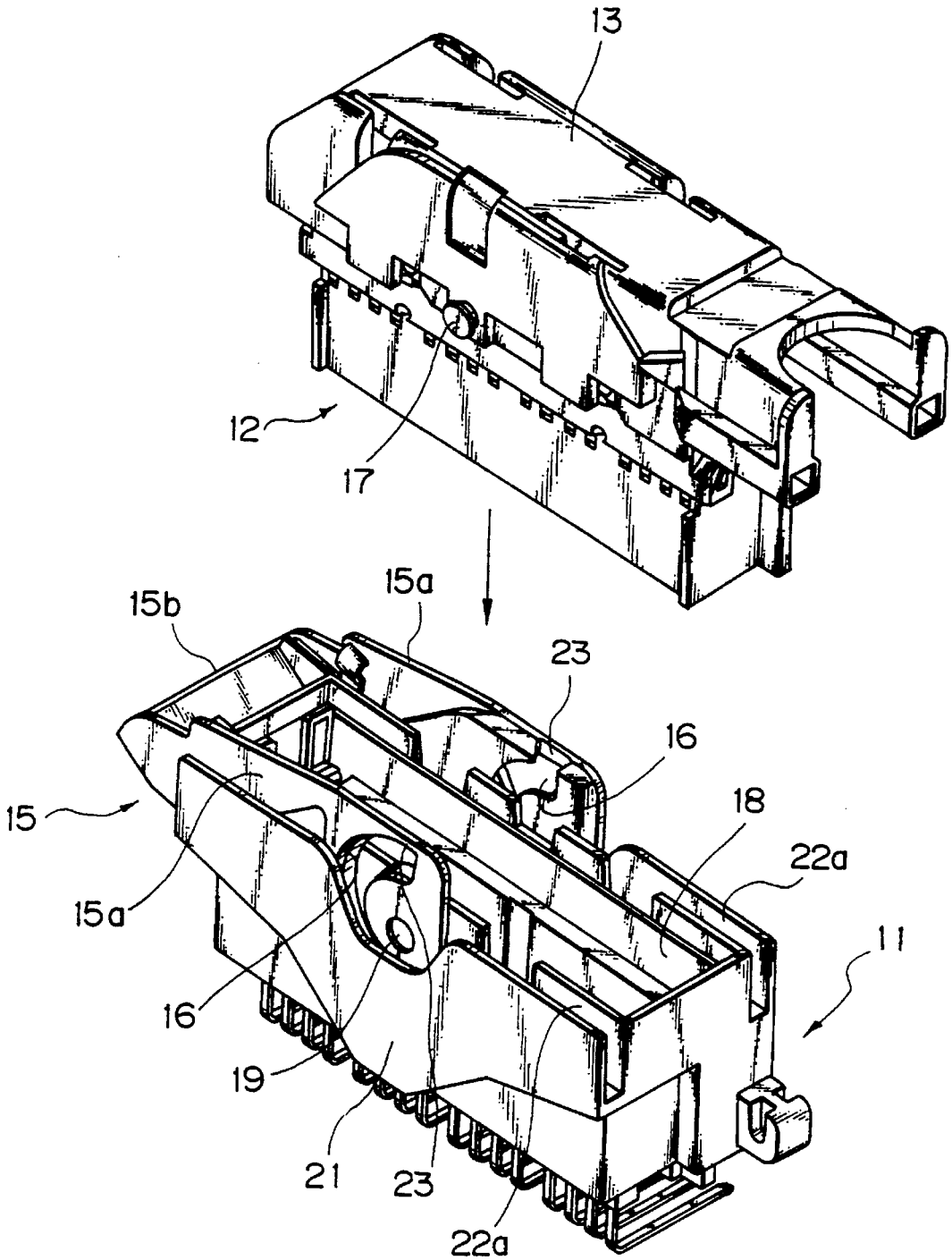
FIGS. 1A–1C are exploded perspective views illustrating first, second and third embodiments, respectively, of a lever connector according to the invention.
Figure 1B:
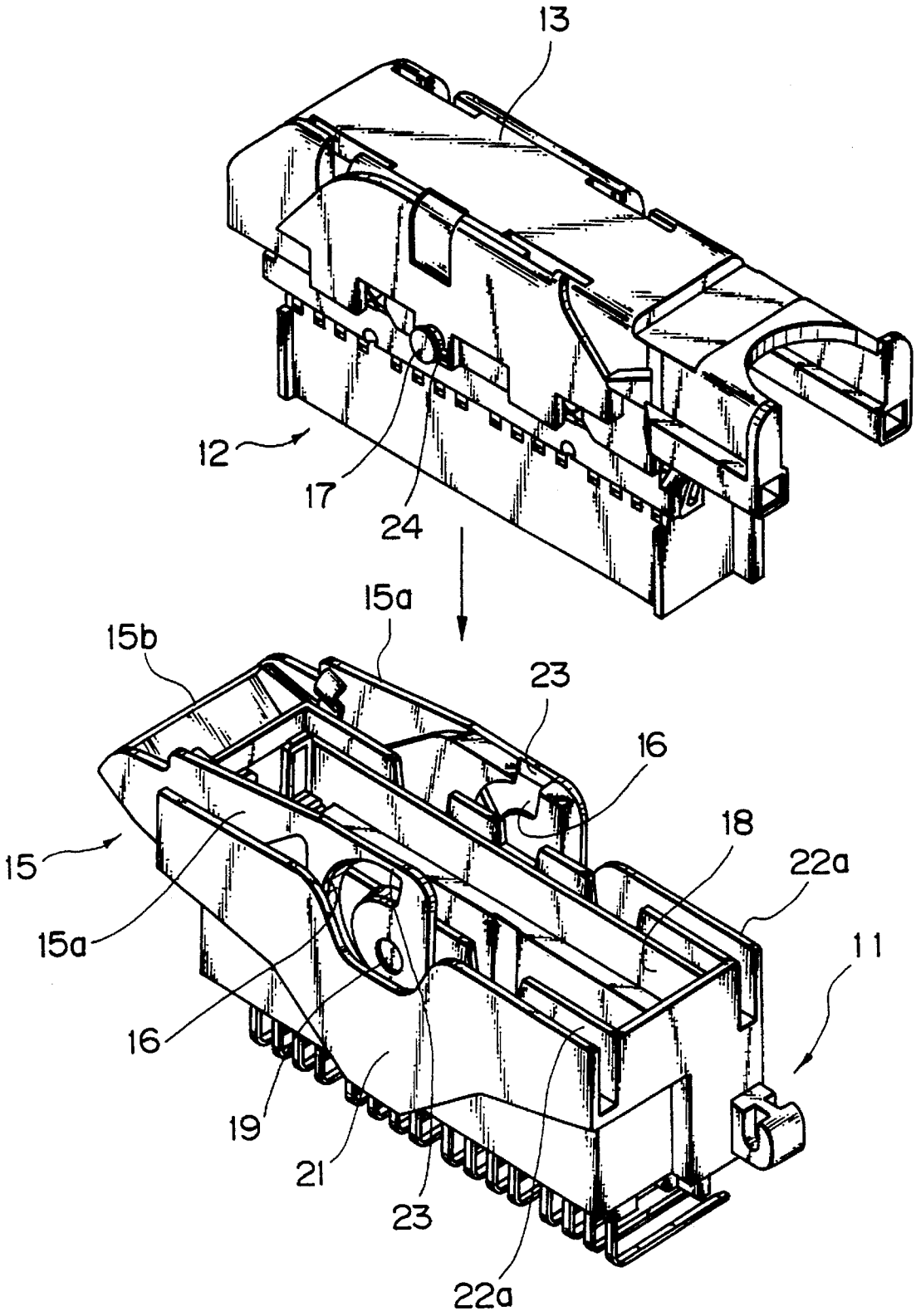
Figure 1C:
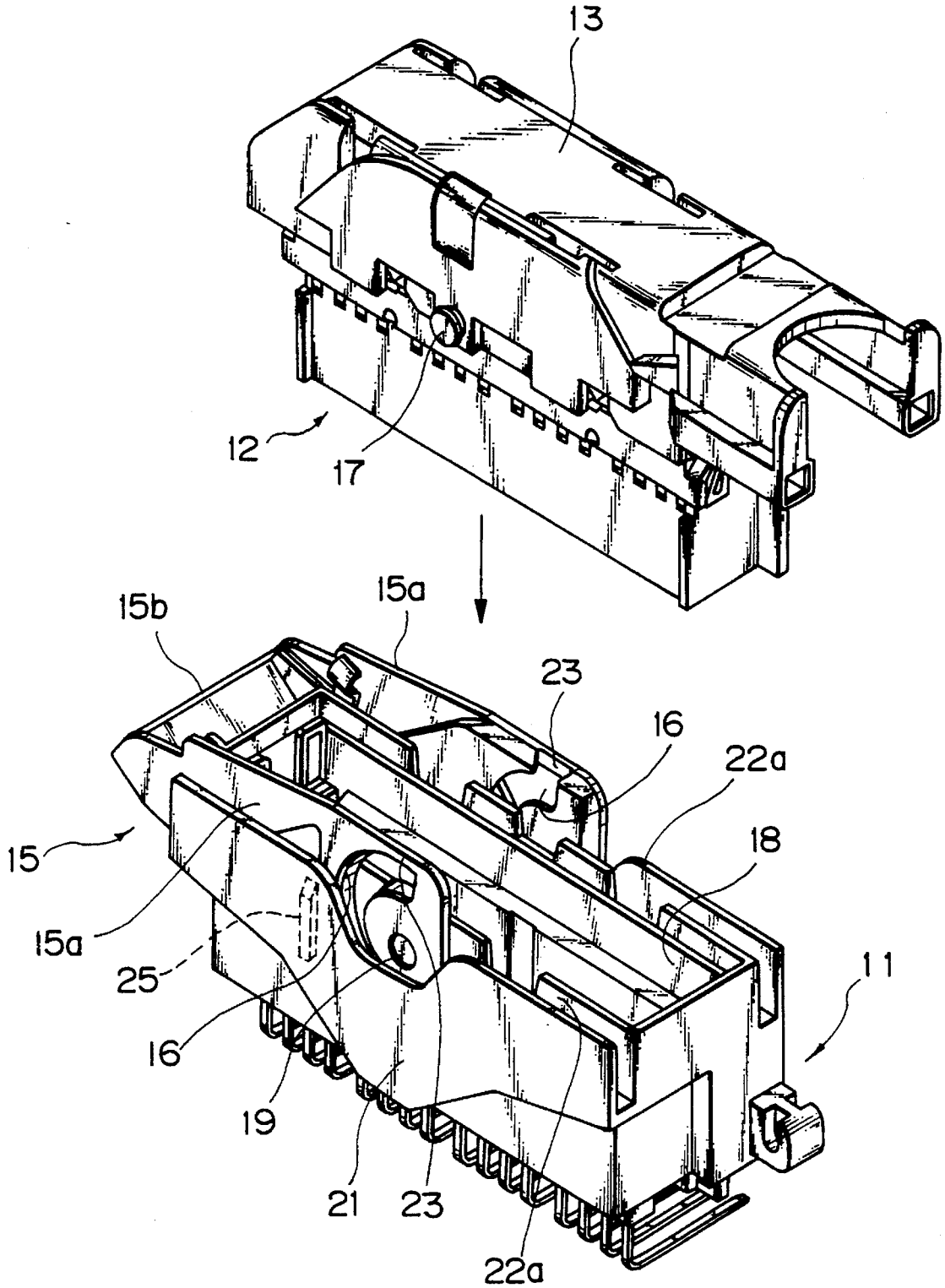

The first preferred embodiment will be explained below according to FIGS. 1A, 2, 3, 4A, 5A and 6. FIG. 1A shows its overall construction; the lower figure shows a male connector housing 11 on which a male terminal (not shown here) is attached. The upper figure shows a female connector housing 12 on which a female terminal (not shown here) is attached.

Above the female connector housing 12, a cover 13 is attached to cover the whole section of its upper part. This cover 13 is engaged to the female connector housing 12 by an engaging mechanism which is not shown in the figure. A cam receiver projecting part 17 is provided horizontally in the center of the side wall to engage the cam groove 16 of the lever 15 which will be explained later.

Figure 4A:
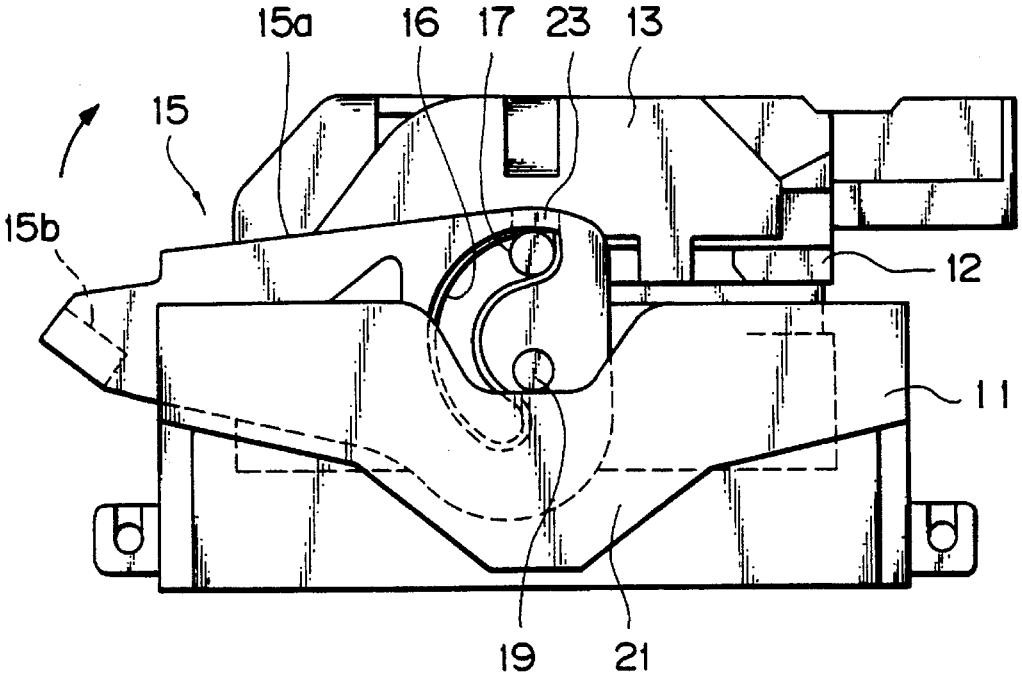
FIGS. 4A–4C are side elevational views illustrating levers according to the first, second and third embodiments, respectively, in their open positions.
Figure 5A:
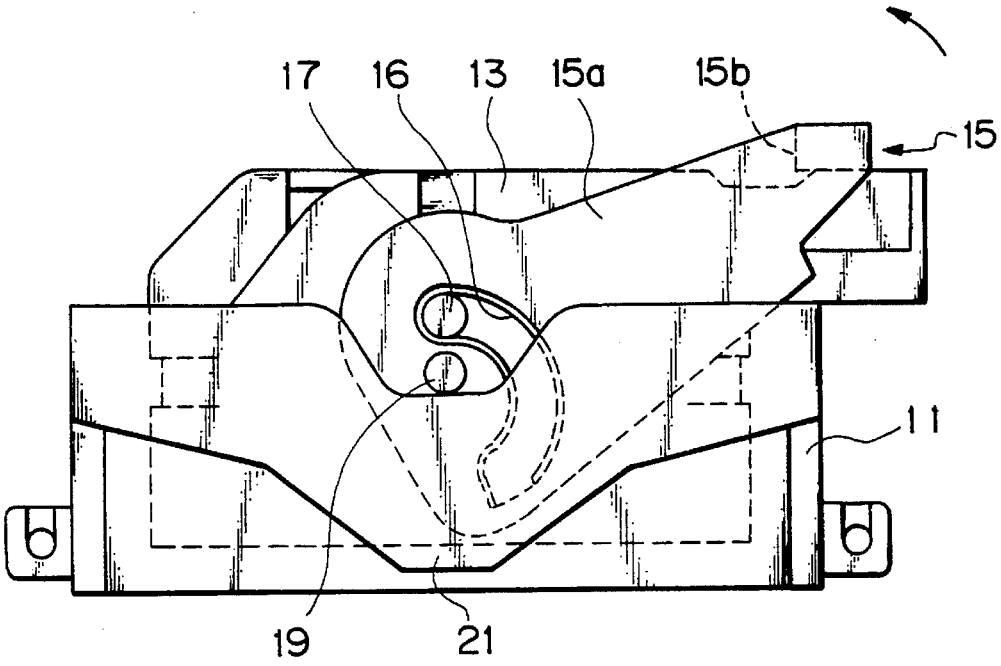
FIGS. 5A–5C are side elevational views illustrating the levers according to the first, second and third embodiments, respectively, in their connected positions.

On the other hand, the above mentioned male connector housing 11 has a rectangular hood 18, the upper part of which can be open. A pair of lever supporting shafts 19 are provided horizontally on the side wall of the hood 18, to which the lever 15 is attached. This lever 15 has two legs connected by a bridge **15*b*. Formed on the individual leg 15*a* is the cam groove 16 to which the cam receiver 17 on the above-mentioned cover 13 is engaged. The cam receiver 17 and cam groove 16 engage to one another. With this engagement, by moving the lever 15 from the "open position" as shown in FIG. 4A to the "connecting position" as shown in FIG. 5A, in the direction of the arrow in the figure, the cover 13 and female connector housing 12, in turn, are forcedly pushed by the cam mechanism into the hood 18 of the male connector housing 11. The connection of the both terminals is made possible by utilizing the above-mentioned mechanism, the function of which is widely known. On the both side walls of the male connector housing 11, an outer wall 21 is provided to cover the lower part of the lever 15 from its side, and the lever housing 22*a*** is formed as a mono-block part thereof.

Figure 6:
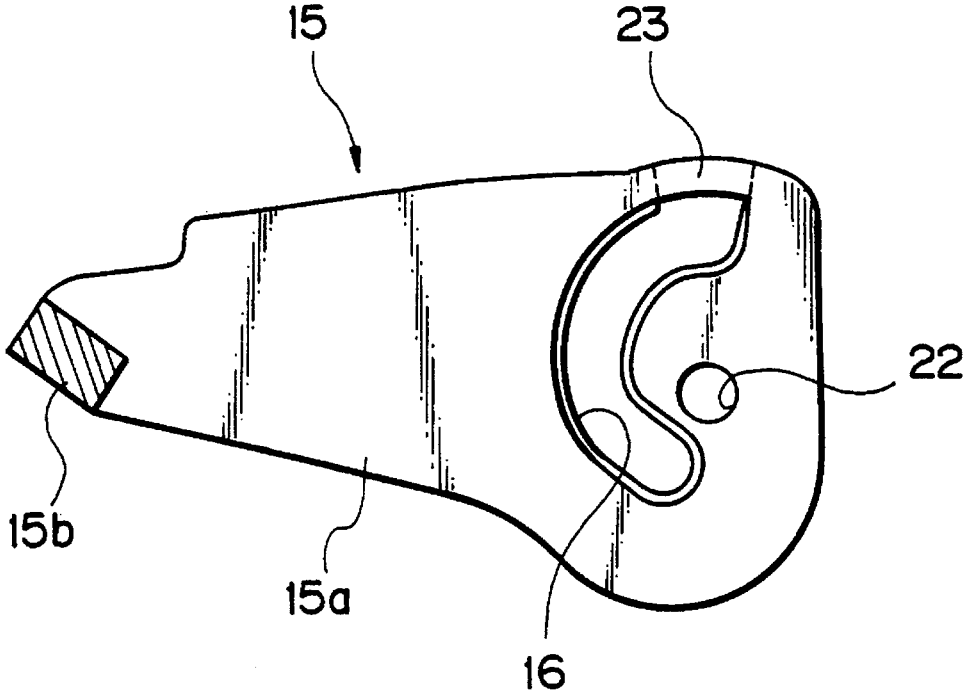
FIG. 6 is a sectional view illustrating backside of lever lugs in the first, second and third embodiments, respectively.

As shown in FIG. 6, the cam groove 16 of the above-mentioned lever 15 has a smooth arc-like shape with its center at the shaft hole 22 to which the lever supporting shaft 19 is fitted. One end of the cam groove is nearest from the shaft hole 22. The other end is farthest from the shaft hole 22 but closest to the outer periphery of the lever 15, the part of which is made by a thin inserting part 23 that makes a closed groove loop. When the female connector housing 12 is assembled to the male connector housing 11 with the lever 15 at its "open position" as shown in FIG. 4A, the cam receiver 17 of the cover 13 goes through and is inserted into the cam groove 16 from the inserting part 23.

Figure 2:
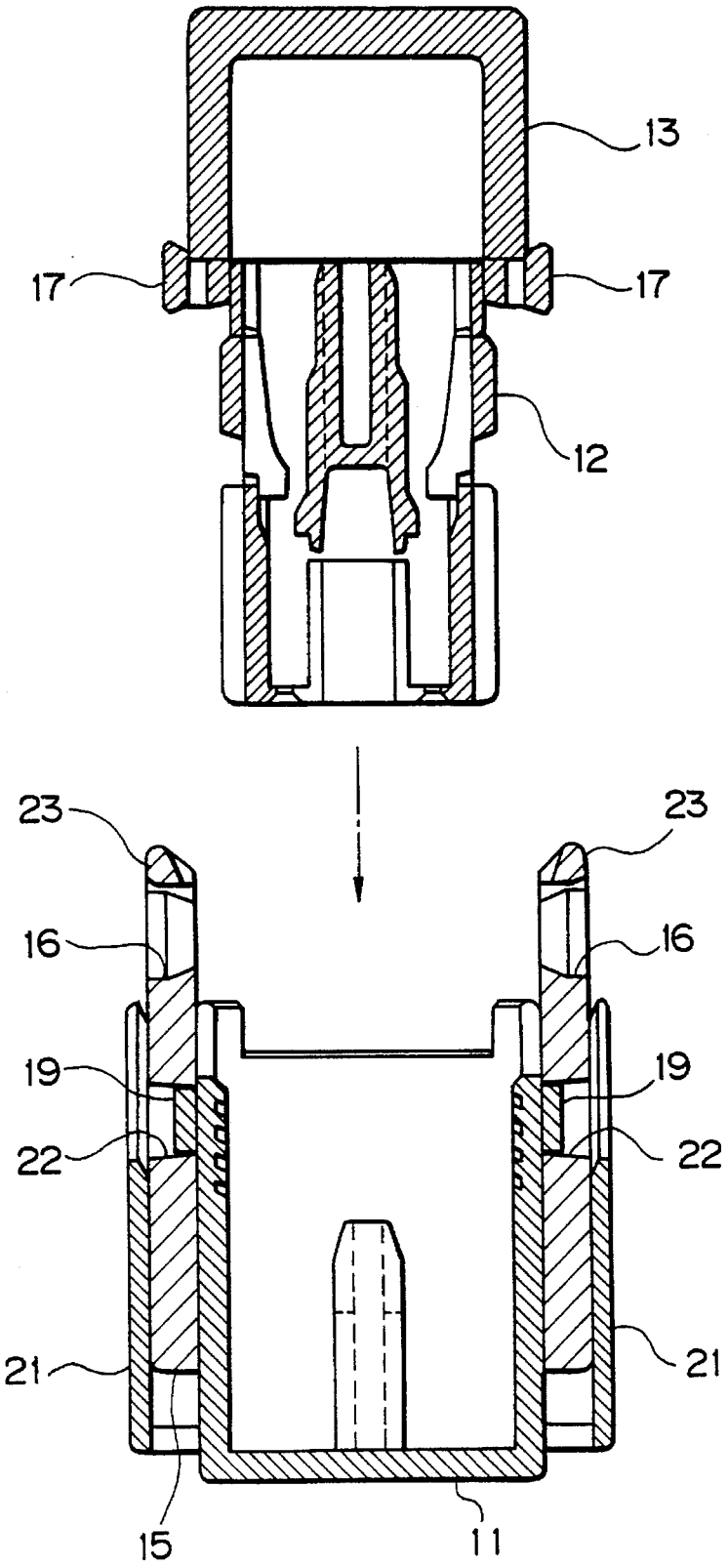
FIG. 2 is a longitudinal sectional view illustrating the lever connectors, prior to connection, according to the first and second embodiments, respectively, of the invention.

The inserting part 23 is thinner than that of the other part in the legs **15*a* of the lever 15. The thickness thereof is designed so that the cam receiver 17 can be inserted by elastically deforming the legs 15*a* of the lever 15 to widen them. After insertion, when the legs 15*a* return to their original condition by elastic deformation, the inserting part 23 engages to the cam receiver 17 to prevent it from separating. As shown In FIG. 2, the inserting part 23 has a taper section whose thickness is thinnest at its outer periphery (upper part in FIG. 2), making it easier to insert the cam receiver 17**.

In the foregoing construction, the assembling of the both connector housings 11 and 12 is made as follows. First, the lever 15 is set at its "open position" as shown in FIG. 4A. The female connector housing 12 on which the cover 13 is attached and male connector housing 11 are held with both hands. Then the lower part of the female connector housing 12 is put on the opening part of the hood 18. At this point, each cam receiver 17 of the cover 13 faces the inserting part 23 of the cam groove 16 on the lever 15.

Figure 3:
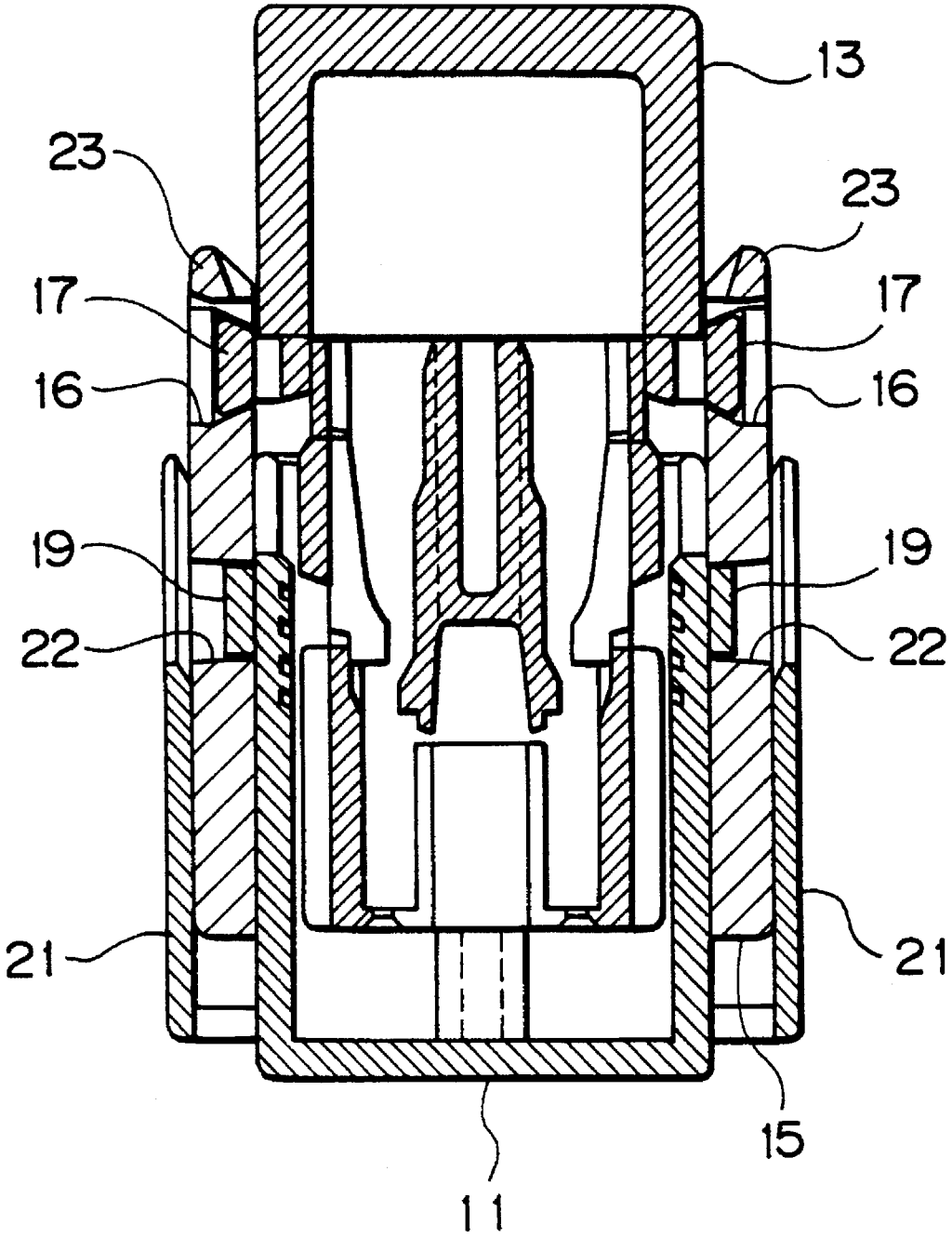
FIG. 3 is a longitudinal sectional view illustrating the lever connectors, after connection, according to the first and second embodiments, respectively, of the invention.

Then, the female connector housing 12 is pushed hard into the hood 18. The cam receiver 17 makes contact with the inserting part 23, and causes the legs 15*a* of the lever 15 to elastically deform and widen. By this deformation, the cam receiver 17 goes trough the inserting part 23 and is inserted into the cam groove 16. Upon completion of the insertion, the legs 15*a* of the lever 15, which have been deformed, return elastically to their original position, by which the cam receiver 17 and inserting part 23 of the cam groove 16 are engaged, preventing them from separating as shown in FIG. 3.

In the foregoing condition, because both connector housings 11 and 12 are engaged, the female connector housing 12 will not separate from the male connector housing 11 even if they are not held together by hand. Then, pulling up the bridge 15*b* of the lever 15 causes the cam receiver 17 to push the cam groove 16 of the lever 15 downward (in FIG. 4A). The cover 13 and female connector housing 12, in turn, are forcedly pushed into the hood 18. Both the male and female terminals of the both connector housings 11 and 12 are completely engaged when the lever 15 reaches at its "connecting position" as shown in FIG. 5A.

To disengage both connectors from the engaged condition as shown in FIG. 5A, the ever 15 is first moved back in the direction of the arrow to the "open position" as shown in FIG. 4A. Then, the male connector housing 11 and cover 13 are shaken horizontally and simultaneously pulled from the side with both hands. The both connector housings 11 and 12 can be disengaged because the cam receiver 17 is taken out from the cam groove 16 by elastically deforming and widening the legs 15*a* of the lever 15.

According to the first preferred embodiment, the cam groove 16 of the lever 15 is formed in a closed loop, and the inserting part 23, from which the cam receiver 17 is inserted into the cam groove 16, has the thickness by which the cam receiver 17 is temporarily engaged by elasticity. Thanks to the foregoing construction, the female connector housing 12 can be temporarily engaged to the male connector housing 11 by using the lever 15. Therefore, engagement is made by a simple work; the female connector housing 12 is first inserted into the hood 18 of the male connector housing 11 for temporary engagement; then the lever 15 is pulled upward by a single hand. This way, the assembling work of connectors can be made considerably more simple, providing efficient work compared to the conventional work for lever type connectors in which workers must pull the lever and simultaneously push the female connector by both hands so that it does not fall off the hood of the male connector housing.

In addition to the excellent effect mentioned above, because the female connector housing 12 is temporarily engaged by the lever 15, engaging hooks on the connector housing are not necessary; in an ordinary engaging construction, engaging hooks are provided on the both connector housings and make under cuts. Due to this construction, the metal mold for connector housings can be made simple, lowering the cost of the metal mold. Also, there are not many holes necessary on the connector housing, permitting its mechanical strength to be kept higher.

Furthermore, according to this preferred embodiment, the cam groove 16 is formed in a closed loop, increasing the strength of the legs 15*a* of the lever 15, and making the assembly work of the both connectors stable. Also, the total weight and cost of the lever 15 can be decreased due to thinner construction.

The present invention is not limited to the foregoing preferred embodiment, and may be applied to variations such as the following:

(a) In the above mentioned preferred embodiment, the cam receiver 17 is attached to the cover 13 which is mounted on the female connector housing 12. However, the cam receiver may be attached directly to the female connector itself.

(b) Contrary to the above mentioned preferred embodiment, the lever may be provided on the female connector housing, and the cam receiver may be provided on the male connector housing.

The second preferred embodiment will be explained below according to FIGS. 1B, 2, 3, 4B, 5B, 6, 7 and 8A–8C. In the second embodiment, the same numerals as those used in the first embodiment indicate the same elements or construction.

Figure 7:
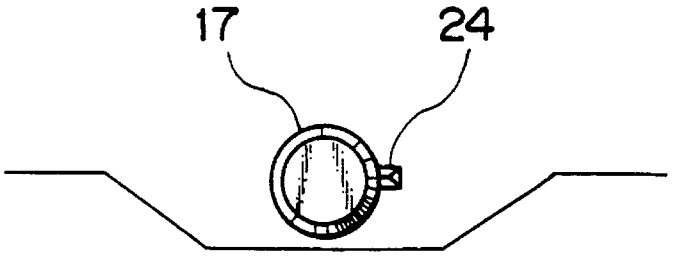
FIG. 7 is a plan view illustrating a protrusion for receiving a cam and restricting protrusion in the second embodiment of the invention.

As shown in the enlarged view of FIG. 7, in the second preferred embodiment, regulating projecting parts 24 are provided individually as part of a mono-block body of the cover 13; the place being close to each of the aforementioned cam receivers 17, e.g., at a horizontal position thereof (the right side in FIG. 7). These regulators are located between the cover 13 and lever 15 with the cam receiver 17 and cam groove 16 engaged. Both legs 15*a* of the lever 15 are expanded for the same distance as its projecting dimension to the direction that such expansion causes the legs to widen.

Figure 4B:
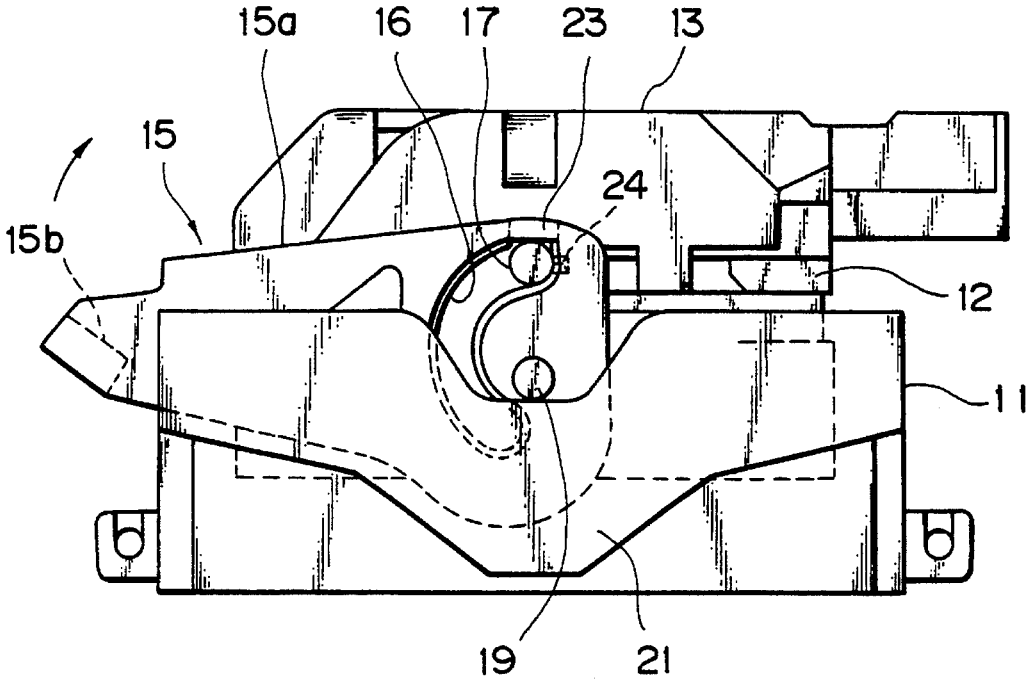

In the aforementioned construction, both connector housings 11 and 12 are engaged in the following manner. The lever 15 is set at the "open position" as shown in FIG. 4B. The female connector housing 12 to which the cover 13 is attached and the male connector housing 11 are held respectively with right and left hands. Then, the lower part of the female connector housing 12 is put on the opening part of the hood 18. At this point, each cam receiver 17 of the cover 13 faces the inserting part 23 of the cam groove 16 on the lever 15.

When the female connector housing 12 is pushed hard into the hood 18, the cam receiver 17 makes contact with the inserting part 23, and legs 15*a* of the lever 15 elastically deform to widen themselves. By this operation, the cam receiver 17 goes through the inserting part 23, and each cam receiver 17 is inserted into the each of the cam groove 16. Upon completion of the insertion of the cam receiver 17 into the cam groove 16, the legs, that have been widened, return to their original position by elasticity, engaging the cam receiver 17 to the inserting part 23 of the cam groove 16 as shown in FIG. 3 preventing them from separating.

In the foregoing condition, because both connector housings 11 and 12 are engaged, the female connector housing 12 will not disengage from the male connector housing 11 even if they are not held together by hand. Pulling up the bridge 15*b* of the lever 15 causes the cam receiver 17 to push the cam groove 16 of the lever 15 downward (in FIG. 4B). The cover 13 and female connector housing 12, in turn, are forcedly pushed into the hood 18. Both the male and female terminals of the both connector housings 11 and 12 are completely engaged when the lever 15 reaches at its "connection position" as shown in FIG. 5B.

Figure 5B:
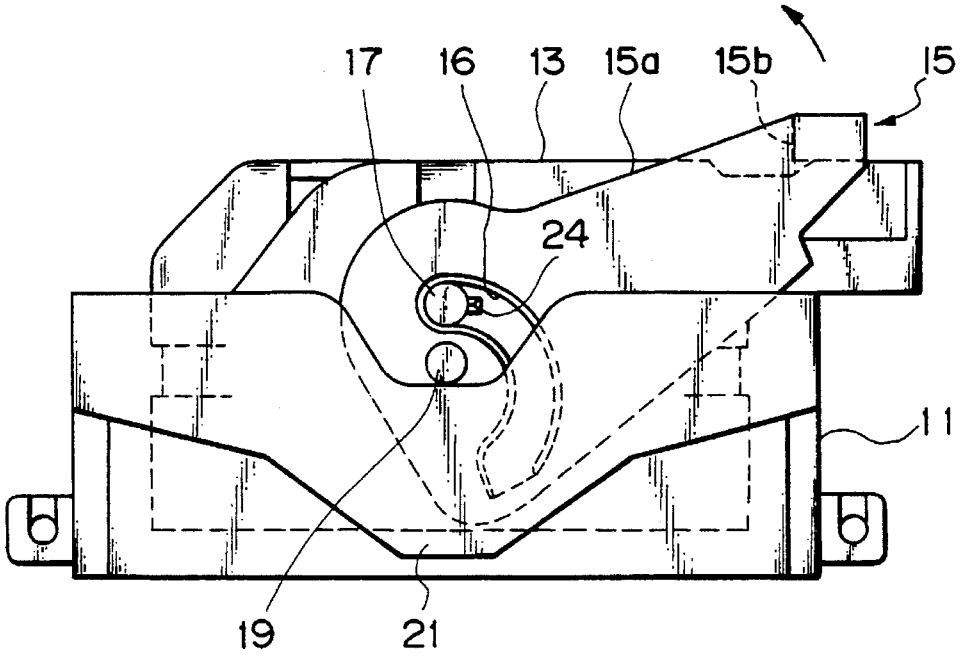

To disengage both connectors from the engaged condition as shown in FIG. 5B, the lever 15 is first moved in the direction of the arrow to the "open position" as shown in FIG. 4B. Then, the male connector housing 11 and cover 13 are shaken horizontally and simultaneously pulled from the side with both hands. The both connector housings 11 and 12 can be disengaged because the cam receiver 17 is pulled out from the cam groove 16 by elastically deforming and widening the legs 15*a* of the lever 15.

Figure 8C:
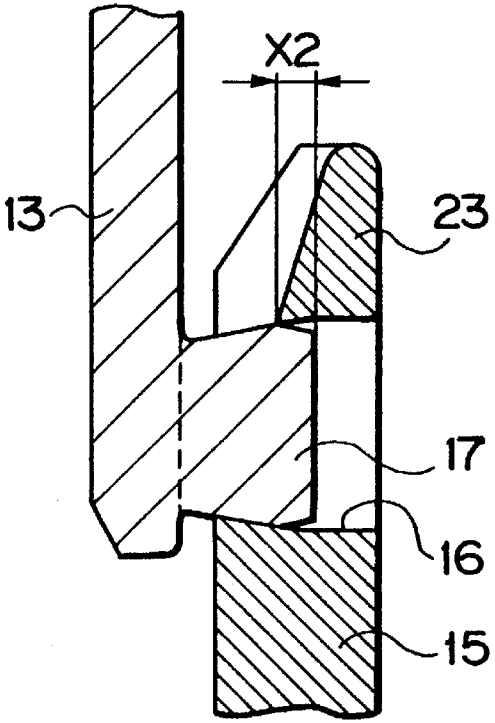
FIGS. 8A–8C are longitudinal sectional views, in part, illustrating the protrusion for receiving the cam and restricting protrusion in the second embodiment of the invention.
Figure 8B:
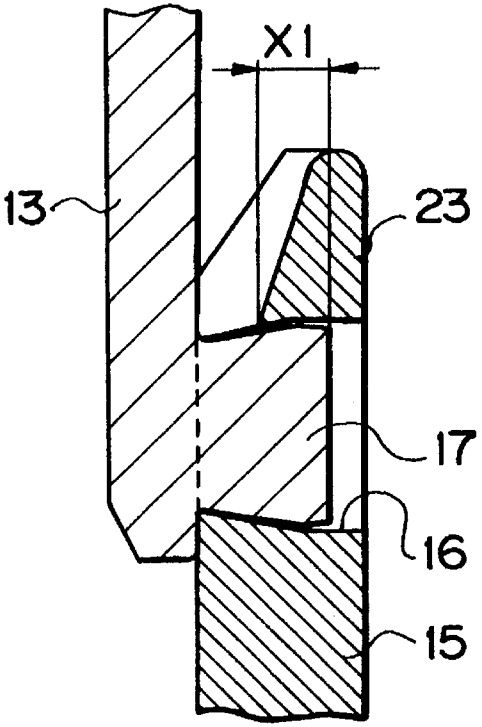
Figure 8A:
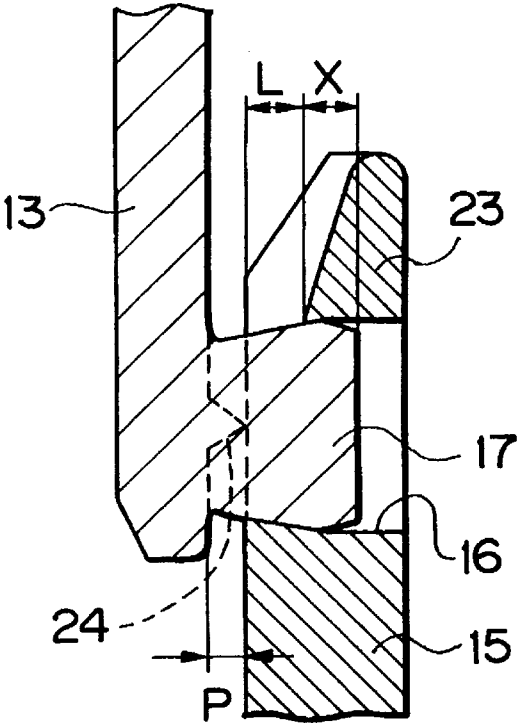

In the engaged condition of the cam receiver 17 and inserting pare 23 as shown in an enlarged figure of FIG. 8A, both legs 15*a* of the lever 15 have been expanded outward for dimension p which is the length of the regulating part 24 because the regulating part 24 is attached horizontally on each cam receiver 17. Therefore, the engaging dimension x for the cam receiver 17 and inserting part 23 of the lever 15 is expressed by the following equation:

$$x=P+L$$

where; L equals the thickness of the leg 15*a* of the lever 15 minus the maximum thickness of the inserting part 23. Both the value of L and projecting dimension P of the regulating part 24 can be formed with high accuracy by mold of the lever 15, providing an accurate value for the above mentioned engaging dimension x, too.

Should the above mentioned projecting part 24 not be provided, the engaging dimension would vary due to the following reasons. The above mentioned dimensions L, P and etc. can be made with high accuracy. However, the distance between the two legs 15*a* of the lever 15 is not necessarily accurate; the reason being that because of the two-leg construction, the distance between the two legs 15*a* varies easily due to molding deformation. If the regulating part 24 is not provided, the legs 15*a* of the lever 15 make contact with the cover 13 as shown in FIG. 8B when the molding deformation is small, leaving the engaging dimension x1. However, when the deformation is large, the legs 15*a* of the lever 15 are apart from the cover 13 as shown in FIG. 8C, leaving the engaging dimension x2 (x2 is smaller than x1). Such dispersion of the engaging dimensions means dispersion of the temporary engagement of the female connector housing 12; the temporary engagement is based on the cam receiver 17 and inserting part 23 of the lever 15. In such a condition, some female connector housings 12 which cannot be engaged temporarily might be produced, resulting in inefficient assembling work.

According to this preferred embodiment using the regulating part 24, because the both legs 15*a* of the lever 15 are widened by the regulating part 24, the engaging dimension x of the cam receiver 17 and inserting part 23 of the lever 15 can be made constant with high accuracy. This keeps the engaging force of the female connector housing 12 at a constant value, providing a highly efficient assembling work.

The present invention is not limited to the foregoing preferred embodiments, and may be applied to variations such as the following:

(a) In the foregoing preferred embodiment, the regulating part 24 is attached on the cover 13. However, it may be attached on the lever 15. In essence, the regulating part 24 is to be located somewhere between the cam receiver or its proximity and the lever to provide a constant engaging dimension with the cam receiver and inserting part.

(b) The cam receiver 17 is attached on the cover 13 which is mounted on the connector housing 12. However, it may be attached on the female connector housing itself.

(c) Furthermore, on the contrary to the foregoing preferred embodiment, the lever may be attached on the female connector housing and the cam receiver may be attached on the male connector housing.

The third preferred embodiment will be explained below according to FIGS. 1C, 4C, 5C, 6 and FIGS. 9 through 12. In the third embodiment, the same numerals as those used in the first preferred embodiment indicate the same elements or construction.

Figure 4C:
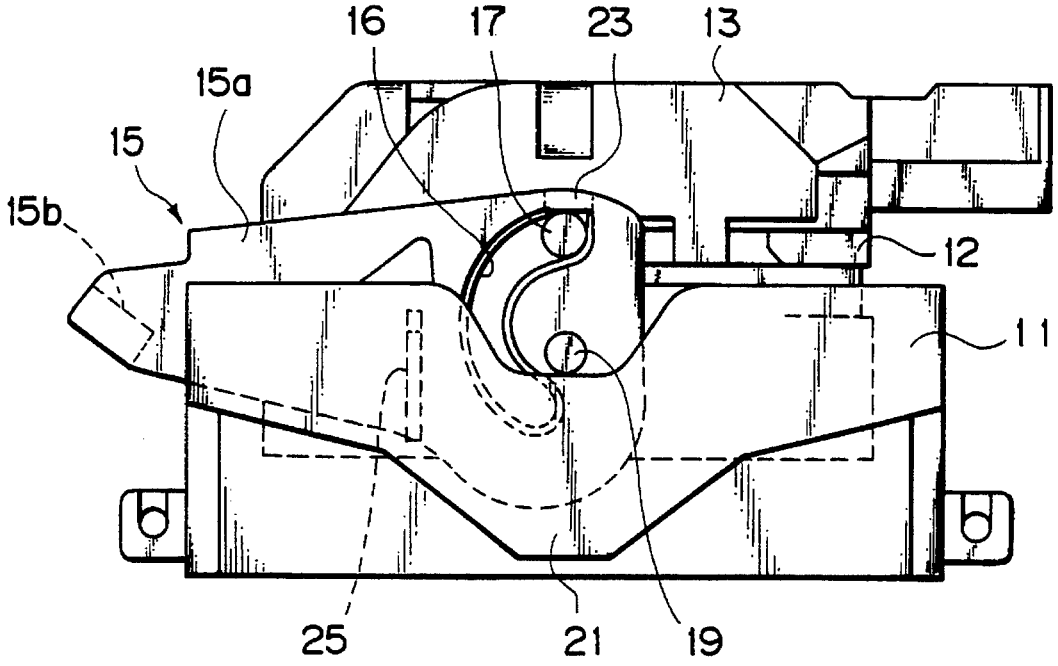

In the third preferred embodiment, regulating part 25 is provided inward as a mono-block part of the lever housing 22*a* on the both side walls of the above mentioned connector housing 11. As shown in FIG. 4C, when the lever 15 is at the "open position", these regulating parts are located at the place where they make contact with the legs 15 of the lever 15. They form projecting springs that extend vertically in the lever housing 22*a*, and its upper end is tapered. The projecting dimension of the regulating part 25 is designed so that it pushes the leg 15*a* of the lever 15 to the outer wall 21.

In the foregoing construction, assembling work of the both connector housings 11 and 12 is made as follows. First, the lever 15 is set at the "open position" as shown in FIG. 4C. The lower part of the legs 15*a* of the lever 15 is expanded outward by the regulating part 25, and makes contact with the inner surface of the outer wall 21. The inserting part 23 of the cam groove 16 is located at the upper most place.

The female connector housing 12 on which the cover 13 is attached and male connector housing 11 are held with both hands. Then, the lower part of the female connector housing 12 is put on the opening part of the hood 18. At this point, each cam receiver 17 of the cover 13 faces the inserting part 23 of the cam groove 16 on the lever 15. Then the female connector housing 12 is pushed hard into the hood 18. The cam receiver 17 makes contact with the inserting part 23, and makes the upper part of the legs 15*a* of the lever 15 elastically deform and widen. By this deformation, the cam receiver 17 goes through the inserting part 23 and is inserted into the cam groove 16. Upon completion of the insertion, the legs 15*a* of the lever 15, which have been deformed, return elastically to their original condition, by which the cam receiver 17 and inserting part 23 of the cam groove 16 are engaged, preventing them from disengaging as shown in FIG. 9.

In the foregoing condition, because both connector housings 11 and 12 are engaged, the female connector housing 12 will not fall apart from the male connector housing 11 even if they are not held together by hand. Then, pulling up the bridge part 15*b* of the lever 15 causes the cam receiver 17 to push the cam groove 16 of the lever 15 downward in FIG. 4C. The cover 13 and female connector housing 12, in turn, are forcedly pushed into the hood 18. Each of the male and female terminals of both connector housings 11 and 12 are completely engaged when the lever reaches at its "connecting position" as shown in FIG. 5C.

Figure 5C:
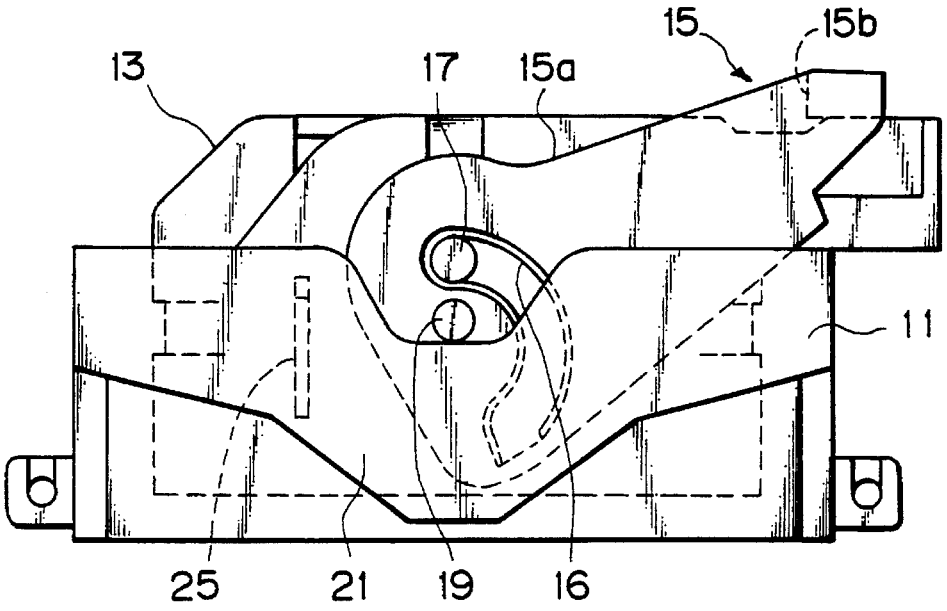

To disengage both connectors from the engaged condition as shown in FIG. 5C, the lever 15 is first moved in the direction of the arrow to the "open position" as shown in FIG. 4C. Then, the male connector housing 11 and cover 13 are shaken horizontally and simultaneously pulled from the side with both hands. The both connector housings 11 and 12 can be disengaged because the cam receiver 17 is taken out from the cam groove 16 by elastically deforming and widening the legs 15*a* of the lever 15.

Figure 9:
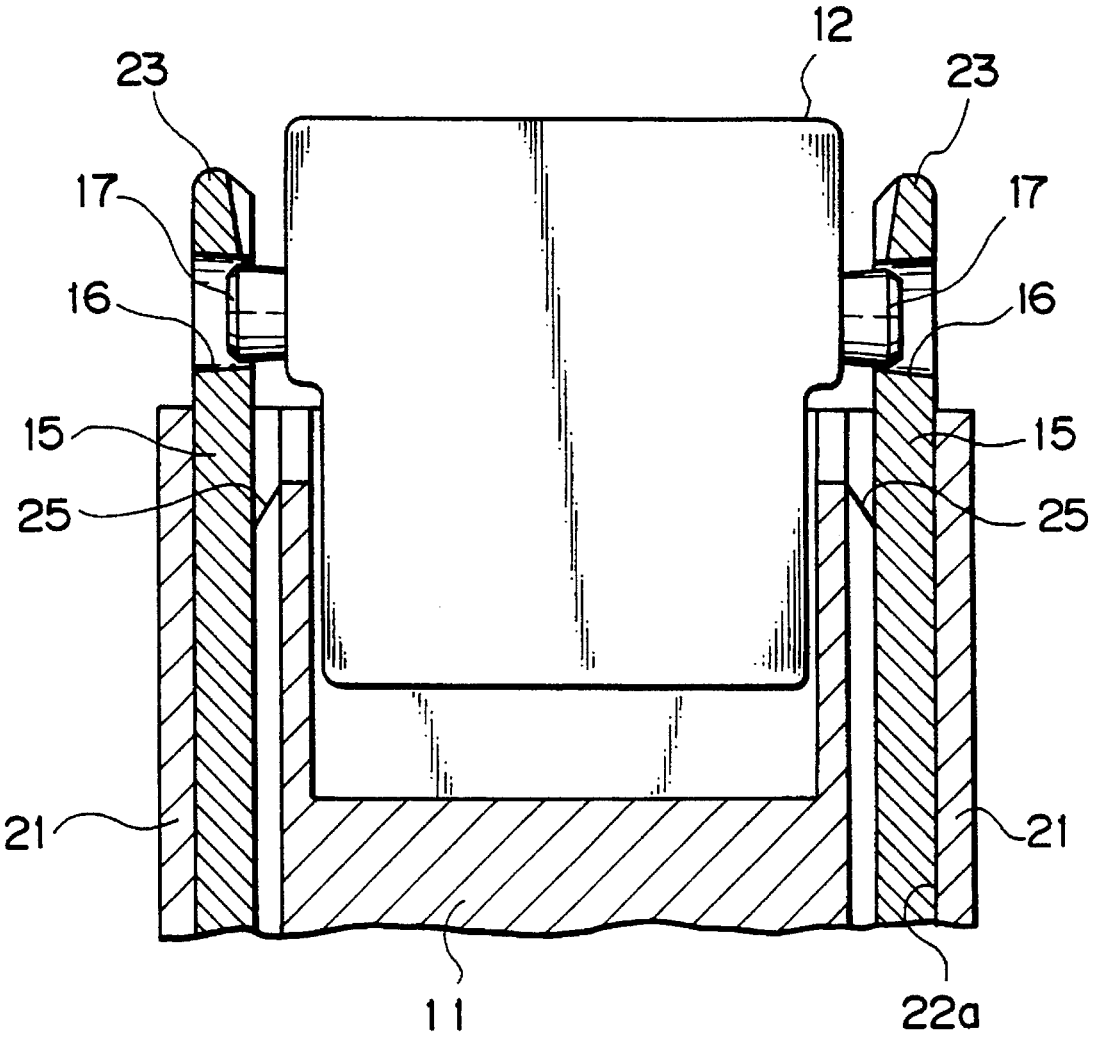
FIG. 9 is a sectional view illustrating the lever connector in the engaged condition according to the third embodiment of the invention.

In the engaged condition of the cam receiver 17 and inserting part 23 as shown in an enlarged view of FIG. 9, regulating part 25 is attached on the side wall of the male connector housing 11. The both legs 15*a* of the lever 15 have been expanded outward and pushed against the inner surface of the outer wall 21 for the same dimension as the length of the projecting part 25. Therefore, the location of each leg 15*a* of the lever 15 is constant to the outer wall 21; providing an accurate engagement dimension for the cam receive 17 and inserting part 23, too.

Should the above mentioned regulating part 25 not be provided, the engaging dimension would vary due to the following reasons. The distance between the male connector housing 11 and outer wall 21 (thickness of the lever housing 22*a*) is set greater than the thickness of the lever 15 in order to tolerate free rotation of the lever 15. In other words, there is some clearance between them. Therefore, the position of the lever 15 varies horizontally within the clearance. For instance, when the lever 15 is attached at the left side as shown in FIG. 10A, the engaging dimension of the cam receiver 17 becomes too small at the left side. Reversely, when the lever 15 is at the right side, it is evident that the engaging dimension becomes too small at the right side, though it is not shown in the figure.

In addition, because the lever 15 has a two-leg construction, the distance between these two legs tends to vary due to molding deformation. The projecting dimension of the cam receiver 17 is determined based on the designed distance between the both legs 15*a* of the lever 15. Therefore, as shown in FIG. 10B, if the distance between both legs 15*a* becomes greater than the designed value due to deformation, the engaging dimensions will become smaller than designed. Conversely, as shown in FIG. 10C, if the distance between the both legs 15*a* becomes smaller than the designed value, the engaging dimension will become greater than designed.

The dispersion of the engaging dimension means dispersion of the temporary engaging force for the female connector housing 12 which is based on the engagement between the cam receiver 17 and inserting part 23 of the lever 15. If the temporary engaging force is too small, the inserted female connector housing 12 will disengage easily. Likewise, if it is too large, it is difficult to disengage the temporarily engaged female connector housing 12. In any case, assembling and disassembling work becomes inefficient.

Contrary to the above, according to the present invention, the female connector housing 12 has regulating part 25 on its side wall. The regulating part 25 pushes both legs 15*a* of the lever 15 against the outer wall 21 with some pressure. The engaging dimension between the cam receiver 17 and inserting part 23 of the lever 15 can be determined accurately, providing a constant value for the temporary engaging force of the female housing 12. This will enhance the efficiency of the assembly work of connectors.

In this preferred embodiment, the regulating part 25 is located at the place where it makes contact with each leg 15*a* when the lever 15 is at the "open position." When the lever 15 is moved from the "open position" to the "connecting position", both legs 15*a* of the lever 15 will not be expanded by the both regulating parts 25. Therefore, when the lever 15 passes the "open position", both legs 15*a* resume their original position by elastically returning to narrow the distance between the two, making the engagement stronger between the cam receiver 17 and cam groove 16. The female connector housing 12 can smoothly be pushed downward.

What is claimed is:

1. A lever type connector comprising a pair of mating connector housings, one of the connector housings including a lever pivotally mounted thereon, said lever including a cam groove formed therein, the other of the connector housings including a cam receiving protrusion for engaging with said cam groove formed in the lever, whereby the pair of connector housings are connected together or disconnected from one another by pivoting the lever so as to displace the cam receiving protrusion, wherein said cam groove comprises a smooth arc-shaped through-opening having a pair of closed ends, one of said closed ends, closest to an outer periphery of said lever and for receiving said cam receiving protrusion, having a reduced thickness inserting portion so that said cam groove is formed into a closed configuration, said reduced thickness inserting portion defining an inner end face which contacts said cam receiving protrusion and which diverges toward the outer periphery of said lever so as to form a tapered guide face; and wherein the thickness of said reduced thickness inserting portion of said cam groove is selected so that it permits advancement of said cam receiving protrusion thereinto by means of resilient deformation of said lever, while preventing dislodgement of said cam receiving protrusion, once advanced, by means of engagement between said cam groove and said cam receiving protrusion.

2. A lever type connector in accordance with claim 1 further comprising a restricting protrusion disposed between the vicinity to said cam receiving protrusion and said lever for maintaining a constant amount of engagement between said cam receiving protrusion and said portion of said cam groove into which said cam receiving protrusion is advanced.

3. A lever type connector in accordance with claim 1 wherein said connector housing provided with said lever includes in the side wall thereof a restricting protrusion for maintaining a constant amount of engagement between said cam receiving protrusion and said portion of said cam groove into which said cam receiving protrusion is advanced.

* * * * *